US007326890B2

(12) United States Patent
Nagahira

(10) Patent No.: US 7,326,890 B2
(45) Date of Patent: Feb. 5, 2008

(54) IMAGE HEATING APPARATUS WITH MOVABLE ELECTROCONDUCTIVE MEMBER

(75) Inventor: Joji Nagahira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,810

(22) Filed: Oct. 21, 2005

(65) Prior Publication Data

US 2006/0086723 A1 Apr. 27, 2006

(30) Foreign Application Priority Data

Oct. 22, 2004 (JP) ..... 2004-308507

(51) Int. Cl.
*H05B 6/14* (2006.01)
*G03G 15/20* (2006.01)

(52) U.S. Cl. ..... 219/619; 219/667; 399/328; 399/330

(58) Field of Classification Search ..... 219/619, 219/667, 665, 650, 652; 399/328–338
See application file for complete search history.

(56) References Cited

U.S. PATENT DOCUMENTS 6,246,843 B1 * 6/2001 Nanataki et al. ..... 399/334
6,492,630 B2 12/2002 Nagahira ..... 219/619
6,605,802 B2 8/2003 Nagahira ..... 219/619
2003/0077093 A1 * 4/2003 Sekiguchi ..... 399/328
2004/0175211 A1 * 9/2004 Sone et al. ..... 399/333
2004/0253027 A1 * 12/2004 Kato et al. ..... 399/328
2006/0049175 A1 * 3/2006 Yokota et al. ..... 219/619
2006/0086723 A1 4/2006 Nagahira ..... 219/619

FOREIGN PATENT DOCUMENTS

JP 10-74009 3/1998

* cited by examiner

*Primary Examiner*—Philip H. Leung
(74) *Attorney, Agent, or Firm*—Fitzpatrick, Cella, Harper & Scinto

(57) ABSTRACT

An image heating apparatus for heating an image on a recording material has a magnetic flux generator for generating a magnetic flux; a heat generation member for generating heat by the magnetic flux generated by the magnetic flux generator; a magnetic flux adjusting member for adjusting the magnetic flux acting on the heat generation member, wherein the heat generation member includes at least a metal layer having a thickness smaller than a thickness of a surface layer, and the magnetic flux adjusting member is disposed at a position across the magnetic flux generator from the heat generation member.

8 Claims, 12 Drawing Sheets

(a)

(b)

IMAGE HEATING APPARATUS WITH MOVABLE ELECTROCONDUCTIVE MEMBER

FIELD OF THE INVENTION AND RELATED ART

The present invention relates to an image forming apparatus such as a full-color printer which employs one of the electrophotographic image forming methods. In particular, the present invention relates to an image heating apparatus which heats an image on recording medium with the use of heat generated by electromagnetic (magnetic) induction.

As an image heating apparatus employing one of the heating methods based on electromagnetic induction, there is a heating apparatus as a fixing apparatus which thermally fixes an image, and which is mounted in such an electrophotographic image forming apparatus as an electrophotographic copying machine, an electrophotographic printer, an electrophotographic facsimileing machine, etc.

In an image heating fixing apparatus of the abovementioned electromagnetic induction type, eddy current is induced in the electrically conductive layer (metallic layer formed of metallic substance in which heat can be generated by electromagnetic induction), that is, the inward layer (substrate) of a fixation roller as a heating means (heating member in which heat can be generated by electromagnetic induction) by the function of the magnetic field (magnetic flux) generated by the magnetic field generating means (magnetic flux generating means), that is, the combination of the exciting coil and magnetic core, and the conductive layer is heated by the heat (Joule heat) generated by this eddy current to heat the fixation roller to a predetermined level, and also, to keep the temperature of the fixation roller at the predetermined level. As for the image fixing process, a recording medium on which an unfixed toner image (toner image which has not been fixed) has been formed, directly or indirectly (unfixed toner image formed on primary image bearing member has been transferred onto recording medium), is conveyed through the nip between the fixation roller, and the pressure roller kept pressed upon the fixation roller, remaining pinched by the fixation roller and pressure roller, so that the unfixed toner image is thermally fixed to the recording medium.

The above described image fixing thermal apparatus, however, suffers from the following problem. That is, as a large number of recording mediums of a small size are consecutively conveyed through the fixing apparatus for image fixation, the temperature of the fixation roller increases beyond the optimal level for toner image fixation (fixation roller overheats), across the portions which correspond to the areas inside the path of a recording medium of the largest size usable with the apparatus and outside the path of a recording medium of a small size, causing such problems that the apparatus increases in internal temperature; a recording medium is thermally deteriorated; etc.

As for the method for preventing the fixation roller from increasing in temperature across the portions which correspond to the areas outside the recording medium path, Japanese Laid-open Patent Application Hei 10-74009 discloses the following one. That is, referring to FIG. 1, a fixing apparatus 110 is provided with a metallic sleeve 11 as a member in which heat is generated by electromagnetic induction, an exciting coil 18, and a magnetic flux blocking means 31 (magnetism blocking plate) for partially blocking the magnetic flux emitted from the exciting coil 18 toward the metallic sleeve 11. Further, it is structured to allow the magnetic flux blocking means 31 to be moved into the space between the internal surface of the metallic sleeve 11 and exciting coil 18. More specifically, the fixation roller 110 is structured so that the magnetic flux blocking means 31 can be varied in position according to the recording medium size and the position of the path of a recording medium relative to the metallic sleeve 11, making it possible control the heat distribution of the metallic sleeve 11, regardless of the size of a recording medium 14.

However, in the conventional fixing apparatus disclosed in Patent Document 1, a substantial amount of space for accommodating magnetic flux blocking means 31 is required between the internal surface of the metallic sleeve 11, and the exciting coil 18 disposed within the hollow of the metallic sleeve 11. It is reasonable to think that this space reduces the amount of the magnetic flux which reaches from the exciting coil 18 to the metallic sleeve 11, reducing the fixing apparatus in heat generation efficiency.

The present invention is intended to provide an image heating apparatus to which electric power is supplied by the optimal amount for the efficiency with which heat is generated in the heating member, regardless of recording medium size.

SUMMARY OF THE INVENTION

The primary object of the present invention is to provide an image heating apparatus to which electric power is supplied by the optimal amount for the efficiency with heat is generated in the heating member, regardless of recording medium size.

According to an aspect of the present invention, there is provided an image heating apparatus for heating an image on a recording material, comprising a magnetic flux generating means for generating a magnetic flux; a heat generation member for generating heat by the magnetic flux generated by said magnetic flux generating means; magnetic flux adjusting means for adjusting the magnetic flux acting on said heat generation member, wherein said heat generation member includes at least a metal layer having a thickness smaller than a thickness of a surface layer, and said magnetic flux adjusting means is disposed at a position across said magnetic flux generating means from said heat generation member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings.

Embodiment 1

(1) Example of Image Forming Apparatus

Figure 12:
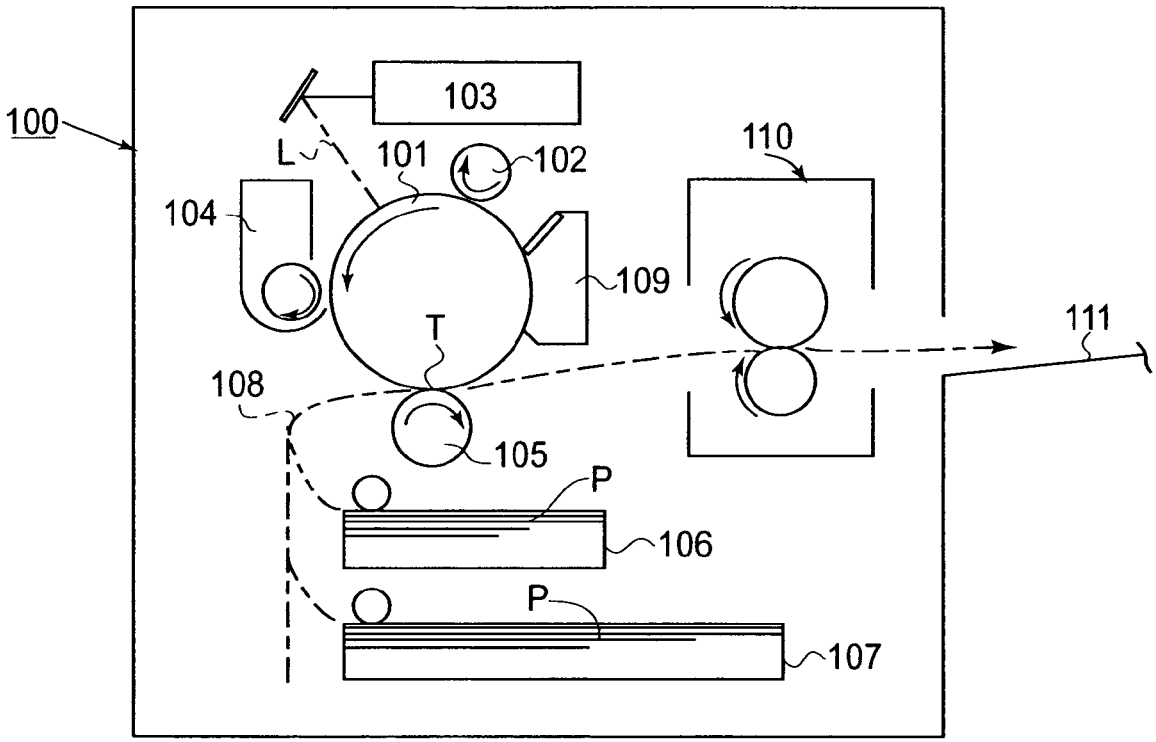
FIG. 12 is a schematic drawing of an example of an image forming apparatus, showing the general structure thereof.

FIG. 12 is a schematic drawing of a typical image forming apparatus employing an image heating apparatus, as a thermal image fixing apparatus 110, in accordance with the present invention, which uses the heating method based on electromagnetic induction, showing the general structure thereof. This example of image forming apparatus 100 is an image forming apparatus of the transfer type, which uses the electrophotographic process and the exposing method based on laser based scanning.

A referential symbol 101 designates an electrophotographic photosensitive member, as an image bearing member, in the form of a rotatable drum (which hereinafter will be referred to simply as photosensitive drum), which is rotationally driven in the clockwise direction indicated by an arrow mark at a predetermined peripheral velocity. As the photosensitive drum 101 is rotated, it is uniformly charged to predetermined polarity and potential level by a charging apparatus 102. The uniformly charged peripheral surface of the photosensitive drum 101 is exposed to a beam of exposing light L projected by an image writing apparatus 103. As the uniformly charged peripheral surface of the photosensitive drum 101 is exposed, numerous exposed points of the uniformly charged peripheral surface of the photosensitive drum 101 attenuate in potential level. As a result, an electrostatic latent image, which matches the exposure pattern, is effected on the peripheral surface of the photosensitive drum 101. The image writing apparatus 103 of this example of an image forming apparatus is a laser scanner, which outputs a beam of laser light L while modulating it with the image formation data. The uniformly charged peripheral surface of the photosensitive drum 101 which is being rotated is scanned (exposed) by this beam of light L. As a result, an electrostatic latent image reflecting the image formation data obtained from the original is formed.

The electrostatic latent image is developed by a developing apparatus 104 into a visible image formed of toner (which hereinafter will be referred to as toner image). The toner image is electrostatically transferred from the peripheral surface of the photosensitive drum 101 onto a sheet of recording medium P (transfer medium), in the transferring portion T, that is, the location of a transfer charging apparatus 105, which is where the photosensitive drum 101 and transfer charging apparatus 105 oppose each other, and to which the recording medium P is conveyed, with a predetermined control timing, from the sheet feeding mechanism.

The sheet feeding mechanism of the image forming apparatus in this embodiment is provided with: a first sheet feeding cassette 106 in which recording mediums of a small size usable with the apparatus are stored; a second sheet feeding cassette 107 in which recording mediums of a large size usable with the apparatus are stored; and a recording medium conveying passage 108 which conveys, with the predetermined timing, to the transferring portion T, each of the recording mediums P fed, while being separated one by one, into the main assembly of the apparatus from the recording medium feeding cassette selected from the recording medium feeding cassettes 106 and 107.

After a toner image is transferred from the peripheral surface of the photosensitive drum 101 onto the recording medium P in the transferring portion T, the recording medium P is separated from the peripheral surface of the photosensitive drum 101, and is conveyed to a fixing apparatus 110, in which the toner image (which has not been fixed) on the recording medium P is fixed to the recording medium P. After the fixation of the toner image, the recording medium P is discharged into a delivery tray 111 located outside the main assembly of the image forming apparatus.

Meanwhile, after the separation of the recording medium P from the peripheral surface of the photosensitive drum 101, the peripheral surface of the photosensitive drum 101 is cleaned, that is, cleared of such adherent contaminants as the toner remaining on the peripheral surface of the photosensitive drum 101, by a cleaning apparatus 109, and then, is used for the next cycle of image formation; the peripheral surface of the photosensitive drum 101 is repeatedly used for image formation.

(2) Example of Fixing Apparatus

Figure 1:
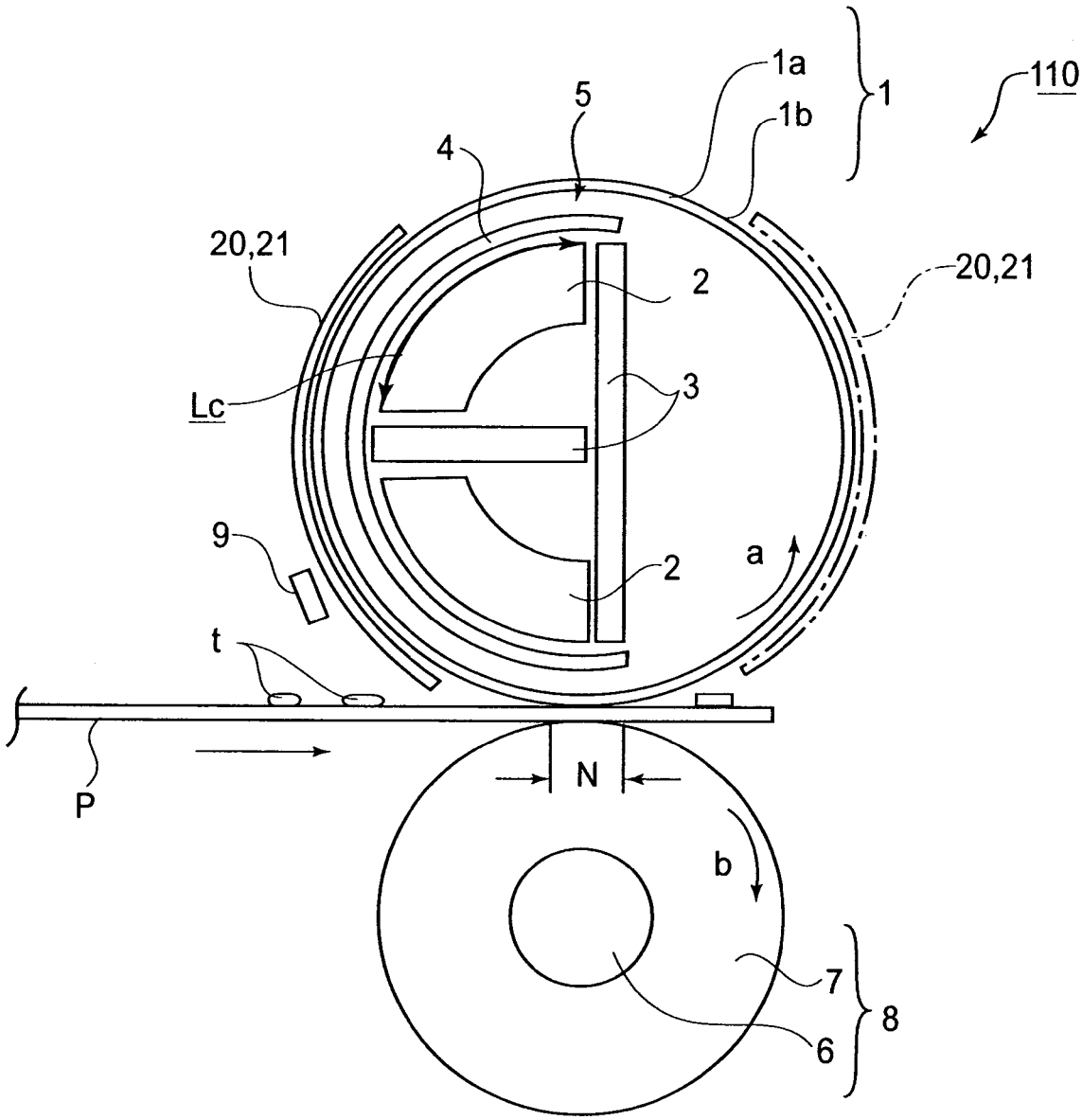
FIG. 1 is a schematic cross-sectional view of the fixing apparatus in the first embodiment of the present invention.
Figure 2:
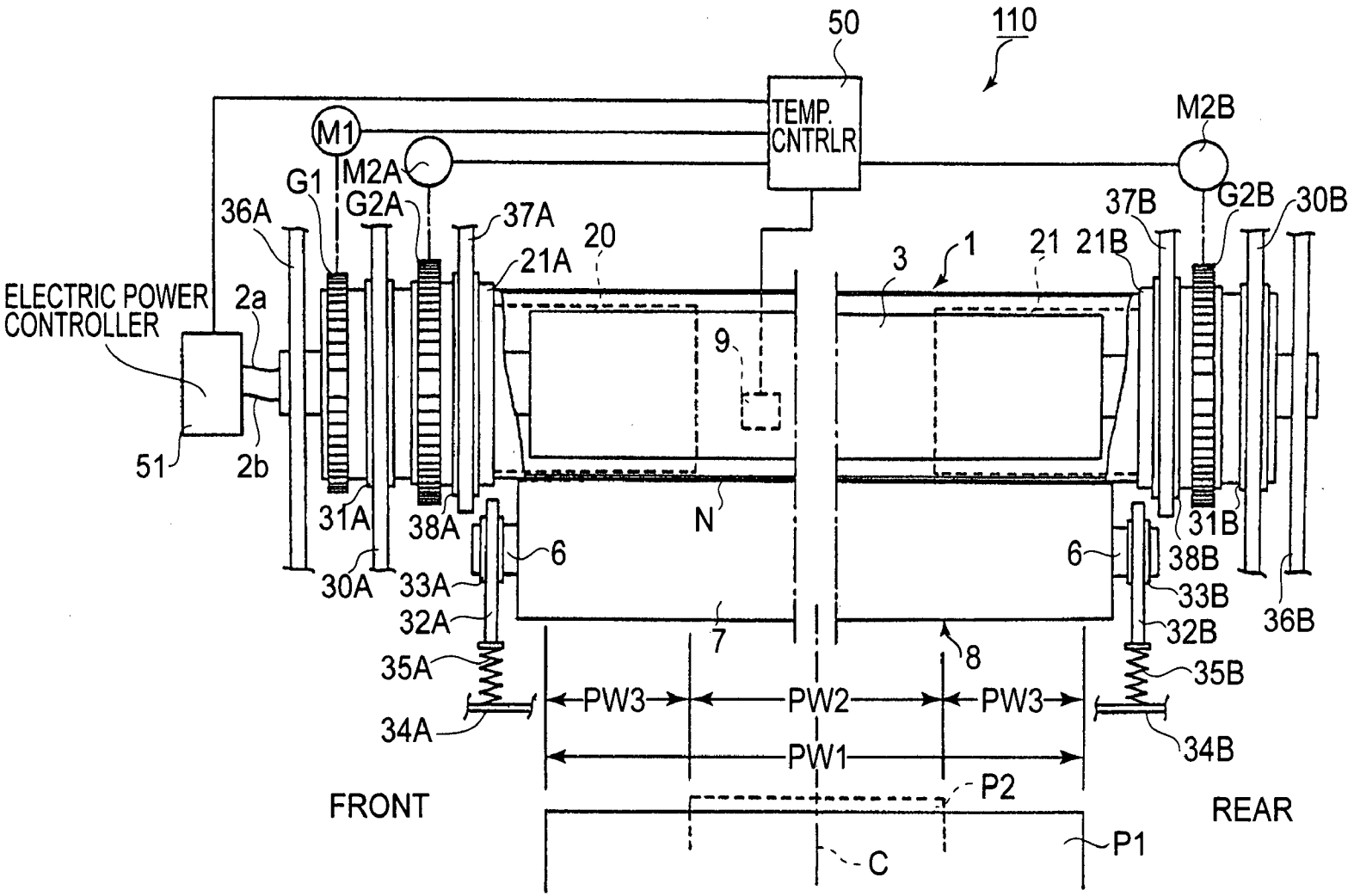
FIG. 2 is a schematic drawing (partially cut-away) of the fixing apparatus in the first embodiment, as seen from the direction perpendicular to the lengthwise direction of the apparatus.

FIG. 1 is a schematic cross-sectional view (perpendicular to lengthwise direction of apparatus) of the fixing apparatus 110 in this embodiment, and FIG. 2 is a schematic vertical sectional view (partially cut-away view) of the fixing apparatus (parallel to lengthwise direction of apparatus).

The fixing apparatus 110 in this embodiment is a heating apparatus employing a heat roller and a heating method based on electromagnetic induction. It essentially has a rotatable member 1 (in which heat is generated by electromagnetic induction) as a heating member, and a pressure roller 8 as a pressure applying rotatable member. The rotatable member 1 and pressure roller 8 are kept pressed against each other with the application of a predetermined amount of pressure so that a pressure nip N (heating nip) as a fixation nip, is formed. As a recording medium P (which hereinafter may be referred to as recording paper) bearing an unfixed toner image t (toner image which has not been fixed) is conveyed through the fixation nip N while remaining pinched between the fixation roller 1 and pressure roller 8, the unfixed toner image t is thermally fixed to the recording medium P by the heat from the fixation roller 1.

The fixation roller 1 is a hollow cylindrical roller made up of a metallic core 1*a* (which may be referred to as metallic layer), and a heat resistant toner releasing layer 1*b* coated on the peripheral surface of the metallic core 1*a*. The metallic core 1*a* is formed of a substance in which heat can be generated by electromagnetic induction. Fixation roller 1 is rotatably supported, at the lengthwise ends, by the front and rear lateral plates 30A and 30B of the chassis of the fixing apparatus 110, with a pair of bearings 31A and 31B disposed between the lengthwise ends of the fixation roller 1 and lateral plates 30A and 30B, respectively. The metallic layer 1*a* may be formed of copper, silver, or aluminum, the specific magnetic permeability of which is roughly 1; the metallic layer 1*a* may be relatively low in magnetic permeability. The toner releasing layer 1*b* is formed of a fluorinated resin such as PTFE or PFA. For the purpose of ensuring that a recording medium P is placed perfectly in contact with the peripheral surface of the fixation roller 1, the fixation roller 1 may be provided with another functional layer, namely, an elastic layer, which is placed between the metallic layer 1*a* and toner releasing layer 1*b*. The elastic layer may be formed of a rubber or a resinous substance which is heat resistant and elastic.

The pressure roller 8, which is disposed under the fixation roller 1, in parallel to the fixation roller 1, is made up of a metallic core 6 and an elastic layer 7 (cylindrical roller) coaxially formed of a heat resistant and elastic substance such as silicone rubber, fluorinated rubber, fluorinated resin, or the like, around the metallic core 6. The pressure roller 8 is rotatably supported, at the lengthwise ends of the metallic core 6, by the lateral plates 32A and 32B of the chassis of the fixing apparatus 110, with a pair of bearings 33A and 33B disposed between the lateral plates 32A and 32B and lengthwise ends of the metallic core 6. Further, the pressure roller 8 is kept pressed on the bottom side of the fixation roller 1 with the application of a predetermined amount of pressure by a pair of pressure applying means 35A and 35B, such as springs, disposed in the compressed state, between a pair of spring supporting members 34A and 34B of the fixing apparatus 110, and lateral plates 32A and 32B. Thus, the heat resistant elastic layer 7 of the pressure roller 8 is kept pressed upon the peripheral surface of the fixation roller 1, being thereby elastically deformed against its own elasticity, by the fixation roller 1, forming between the pressure roller 8 and fixation roller 1, a fixation nip N, as a recording medium heating portion, having a predetermined width.

Incidentally, if the fixation roller 1 is not rigid enough to cause the pressure roller 8 to elastically deform to form the fixation nip N, a stay (unshown) for backing the fixation roller may be disposed within the hollow of the fixation roller 1 to back the fixation roller 1 from within the fixation roller 1 so that the wall of the fixation roller 1 will withstand the predetermined amount of pressure applied to the bottom portion of the fixation roller 1 by the pressure roller 8.

Designated by a referential symbol 5 is a heating assembly, that is, a magnetic field generating means as a magnetic flux generating means. The heating assembly 5 is such an assembly that comprises an exciting coil 2, a magnetic core 3 (iron core) having a roughly T-shaped cross-section, a holder 4 (external shell) shaped like a semicylindrical trough, etc. The magnetic core 3 is formed of a magnetic substance, for example, ferrite. It may be a solid core, or a multilayer core. Its length is roughly the same as that of the fixation nip N. The exciting coil 2 is formed of multiple strands of copper wire wound multiple times around the magnetic core 3 so that its outward contour matches the curvature of the internal surface of the holder 4, and also, so that the lengthwise direction of the exciting coil 2 becomes parallel to the lengthwise direction of the fixation nip N. In other words, the exciting coil 2 is wound so that it looks like the bottom portion of a boat. Thus, the exciting coil 2 is roughly divided into the top and bottom halves, which oppose the fixation roller 1, by the portion of the magnetic core 3, which corresponds to the vertical section of a letter T. The magnetic core 3 and exciting coil 2 are disposed in the holder 4 so that the magnetic core 3 becomes perpendicular to the copper wires of the exciting coil 2. As for the material for the holder 4, heat resistant nonmagnetic substances such as PPS resin, PEEK resin, polyimide resin, polyamide resin, polyamide-imide resin, ceramic, liquid polymer, etc., are suitable. The heating assembly 5, which includes the exciting coil 2, is disposed in (inserted into) the hollow of the fixation roller 1, being rigidly (non-rotatably) supported, at its lengthwise ends, by the lateral plates 36A and 36B of the chassis of the heating assembly 5 of the fixing apparatus, at a predetermined angle, with the provision of a predetermined gap between the heating assembly 5 and the internal surface of the fixation roller 1.

Designated by a referential symbol 9 is a temperature detecting means made up of a temperature detection element such as a thermistor, or the like, which is supported in the adjacencies of the fixation roller 1 by an unshown supporting member, with no contact between the peripheral surface of the fixation roller 1 and the temperature detecting means 9. It detects the temperature of the fixation roller 1 while the fixation roller 1 is in the heated condition. Incidentally, the temperature detection element 9 may be supported elastically in contact with the peripheral surface of the fixation roller 1, by the supporting member.

Designated by a referential symbol 50 is a control circuit as a controlling means. As soon as the main electrical power source of the image forming apparatus is turned on, the control circuit 50 activates a first driving system M1 to rotationally drive a fixation roller driving gear G1 attached to one of the lengthwise ends of the fixation roller 1, rotating thereby the fixation roller 1 in the counterclockwise direction indicated by an arrow mark a (FIG. 1). The pressure roller 8 follows this rotation of the fixation roller 1, rotating therefore in the clockwise direction indicated by an arrow mark b.

Further, the control circuit 50 controls an electric power controlling apparatus 51 to supply the exciting coil 2 of the heating assembly 5 in the hollow of the fixation roller 1, with electric power (high frequency electric current) from the electric power controlling apparatus 51 through a pair of electric wires 2*a* and 2*b* for supplying the exciting coil 2 with electric power. As the exciting coil 2 is supplied with the electric power, it generates magnetic flux (alternating magnetic field), which induces eddy current in the wall of the fixation roller 1, and this eddy current generates heat (Joule heat: heat generated by loss of eddy current) in the wall of the fixation roller 1, which includes the metallic layer 1*a*. The temperature of the fixation roller 1 is detected by the temperature detection element 9, and the signals reflecting the detected temperature levels of the fixation roller 1 are inputted into the control circuit 50, which controls the temperature of the fixation roller 1 by controlling the amount by which electric power is supplied to the exciting coil 2 of the heating assembly 5 from the electric power controlling apparatus 51 so that the detected temperature of the fixation roller 1 is maintained at a level (target level) suitable for image fixation.

In other words, while the fixation roller 1 and pressure roller 8 are rotationally driven as described above, high frequency electric current (eddy current) is induced in the metallic layer 1*a* of the fixation roller 1 by the alternating magnetic field which is generated by supplying the exciting coil 2 of the heating assembly 5 with the high frequency electric current. As a result, heat is generated in the metallic layer 1*a* by the eddy current electromagnetically induced in the metallic layer 1*a*, heating thereby the fixation roller 1. While the temperature of the fixation roller 1 is kept at the predetermined image fixation level, a recording medium P bearing an unfixed toner image t (which has been electrostatically transferred onto the recording medium P, in aforementioned transferring portion of image forming apparatus) is introduced into the fixation nip N of the fixing apparatus 110, and conveyed through the fixing apparatus 110 while remaining pinched by the fixation roller 1 and pressure roller 8. While the recording medium P bearing the toner image is conveyed through the fixating apparatus 110, the unfixed toner image t on the recording medium P is fixed to the recording medium (turned into permanent image) by the heat from the fixation roller 1 and the pressure in the fixation nip N.

(1) Countermeasure for Temperature Increase in Areas Outside Recording Medium Path The temperature of the fixation roller 1 is controlled by the control systems 50 and 51, inclusive of the temperature detection element 9, so that the surface temperature of the fixation roller 1 remains at the optimum level for image fixation. Therefore, it does not occur that the temperature of the fixation roller 1 exceeds the temperature level set for image fixation, while the fixing apparatus 110 is kept on standby, or recording mediums P are conveyed through the fixing nip N. As the magnetic flux generated by the heating assembly reaches the peripheral surface of the fixation roller 1, it permeates through the wall of the fixation roller 1, gradually reducing in density. In other words, it is highest in density index at the surface, and the deeper it permeates, the lower it becomes in density index (surface effects). The amount of the distance, from the surface of an object, which the magnetic flux permeates through the object before its density reduces to 0.368 times its density at the surface of the object, is called skin depth (depth of penetration), which is represented by a Greek character d. This skin depth d can be expressed by the following mathematical formula.

$$d=(p\times f\times\mu\times s)^{1/2} \quad (1)$$

f: frequency of electric current supplied to heating assembly

μ: permeability of fixation roller s: conductivity of fixation roller.

The surface resistance Rs can be expressed by the following mathematical formula:

The conductivity of the metallic layer 1*a* of the fixation roller 1 is set to a predetermined value. The thickness of the metallic layer 1*a* is set to a value smaller than the skin depth (penetration depth) of the induction current, which is determined by the frequency of the electric current supplied to the heating assembly 5 to generate the magnetic field, which equals the frequency of the high frequency current generated by the magnetic field, and the material of the metallic layer 1*a*. Therefore, various parts F' of the magnetic flux F generated by the exciting coil 2 leak into the adjacencies of the fixation roller 1 after penetrating through the fixation roller 1 (FIG. 4(*a*)). In this embodiment, the thickness of the metallic layer 1*a* is set to 0.05 (mm).

In this embodiment of the present invention, the recording medium P is guided into the fixing apparatus 110 so that its center line parallel to the recording medium conveyance direction aligns with the center of the fixation roller 1 in terms of the lengthwise direction of the fixation roller 1 (central alignment). Referring to FIG. 2, a referential symbol C stands for the referential line (centerline), and a referential symbol PW1 stands for the area which corresponds to the maximum heatable range of the fixation roller 1, that is, the path of a recording medium of the largest size P1 (FIG. 3) usable with the image forming apparatus (hereinafter, maximum heatable range may be referred to as path of largest recording medium). A referential symbol PW3 designates the area of the area PW1, which is outside the path of a recording medium of a size smaller than the largest one, and a referential symbol PW2 designates the area, which corresponds in size and position to the path of a recording medium of the smaller size, that is, the area of the PW1, which is not the area PW3. In other words, the area PW2 is the section of the area PW1, which corresponds to the path of a recording medium of a size smaller than that of the largest recording medium, that is, a recording medium of the size P2 (FIG. 3) (hereinafter, area PW2 may be referred to as path of small recording medium).

The temperature detection element 9 for the fixation roller 1 is located to detect the surface temperature of the fixation roller 1, in the path PW2 of a small recording medium. The amount of the electric power supplied to the exciting coil 9 is controlled by the control system 50ù51, inclusive of the temperature detection element 9, so that the surface temperature of the portion of the fixation roller 1, which corresponds to the path PW2 of a small recording medium, is kept at the optimal level for image fixation.

Thus, while multiple small recording mediums of the size P2 are consecutively conveyed through the fixation nip N, the temperature of the fixation roller 1 is controlled by the control system 50ù51, inclusive of the temperature detection element 9, so that the surface temperature of the portion of the fixation roller 1, which corresponds to the path of a recording medium of the small size P2, is kept at the predetermined optimal level for image fixation. However, the portions of the fixation roller 1, which correspond to the areas PW3, that is, the areas outside the path of a small recording medium, increase beyond the predetermined optimal level for image fixation (phenomenon that temperature of fixation roller unwantedly increases across areas outside recording medium path).

In this embodiment, therefore, in order to solve the above described problem regarding this unwanted temperature increase of the fixation roller 1 across the portions outside the area corresponding to the path of a recording medium of the small size P2, a pair of magnetic circuit alternating members 20 and 21 as a magnetic flux adjusting means, that is, magnetic circuit altering means, are placed so that they overlap, in terms of the direction perpendicular to the lengthwise direction of the fixation roller 1, with the portions of the fixation roller 1, which correspond in size and position to the areas PW3, in terms of the lengthwise direction of the fixation roller 1, and also, so that they can be rotationally moved relative to the fixation roller 1, within the areas PW3.

(4) Magnetic Circuit Altering Members

Figure 3:
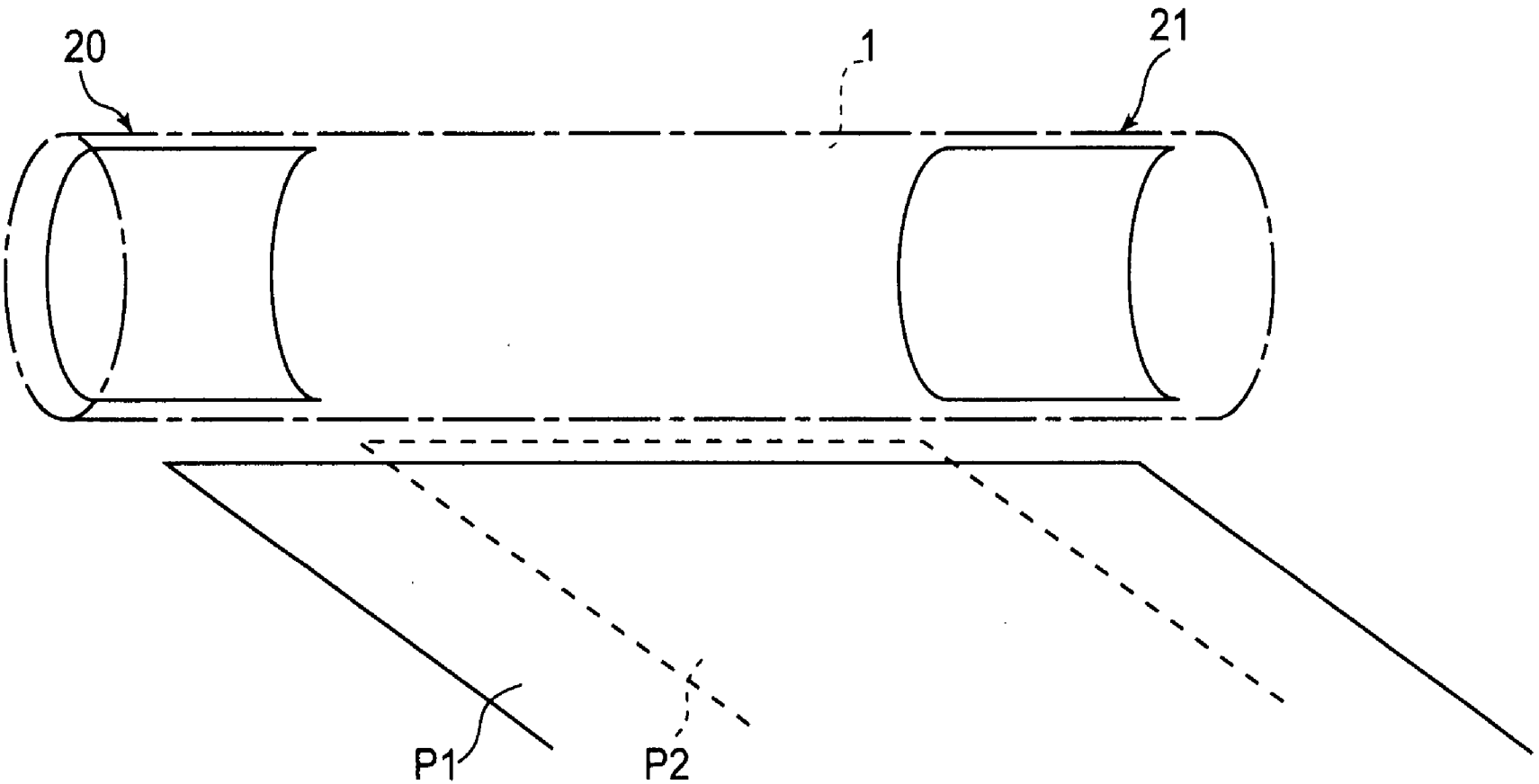
FIG. 3 is a perspective view of the magnetic circuit altering member employed by the fixing apparatus of the first embodiment.

FIG. 3 is an external perspective view of the magnetic circuit altering members 20 and 21. The magnetic circuit altering members 20 and 21 are roughly semicylindrical members, the curvature of which matches that of the peripheral surface of the fixation roller 1. As for the material for the magnetic circuit altering members 20 and 21, the same substance as the one for the metallic layer 1*a* of the fixation roller 1 is used. The magnetic circuit altering members 20 and 21 are the same in conductivity and thickness as the metallic layer 1*a*.

The magnetic circuit altering member 20 is provided with a cylindrical supporting member 20A (FIG. 2) attached to the outward end of the magnetic circuit altering member 20 in terms of the lengthwise direction of the fixation roller 1. The supporting member 20A is rotatably supported by a bearing 38A attached to the lateral plate 37A of the chassis of the fixing apparatus. One of the lengthwise end portions of the fixation roller 1 is in the hollow of the supporting member 20A, with no contact between the fixation roller 1 and supporting member 20A. The magnetic circuit altering member 21 is provided with a cylindrical supporting member 21B (FIG. 2) attached to the outward end of the magnetic circuit altering member 21 in terms of the lengthwise direction of the fixation roller 1. The supporting member 21B is rotatably supported by a bearing 38B attached to the lateral plate 37B of the chassis of the fixing apparatus. The other lengthwise end portion of the fixation roller 1 is in the hollow of the supporting member 21A, with no contact between the fixation roller 1 and supporting member 21A. In other words, the fixing apparatus 110 is structured so that the wall of the fixation roller 1 is disposed between the heating assembly 5 and magnetic circuit altering members 20 and 21.

The supporting members 20A and 20B are provided with magnetic circuit altering member driving gears G2A and G2B, which are rigidly attached to the supporting members 20A and 20B, respectively, so that the magnetic circuit altering members 20 and 21 can be rotated by driving force transmission systems M2A and M2B controlled by the control circuit 50, from their predetermined standby positions into the positions, outlined by a solid line in FIG. 2, in which they oppose the exciting coil 2, that is, the positions where the magnetic flux F is higher in density (positions in which they stand between heating assembly and fixation roller), or the positions, outlined by a double-dot chain line in FIG. 2, in which they do not oppose the exciting coil 2, that is, where the magnetic flux F is lower in density (positions in which they do not stand between heating assembly and fixation roller).

Figure 4:
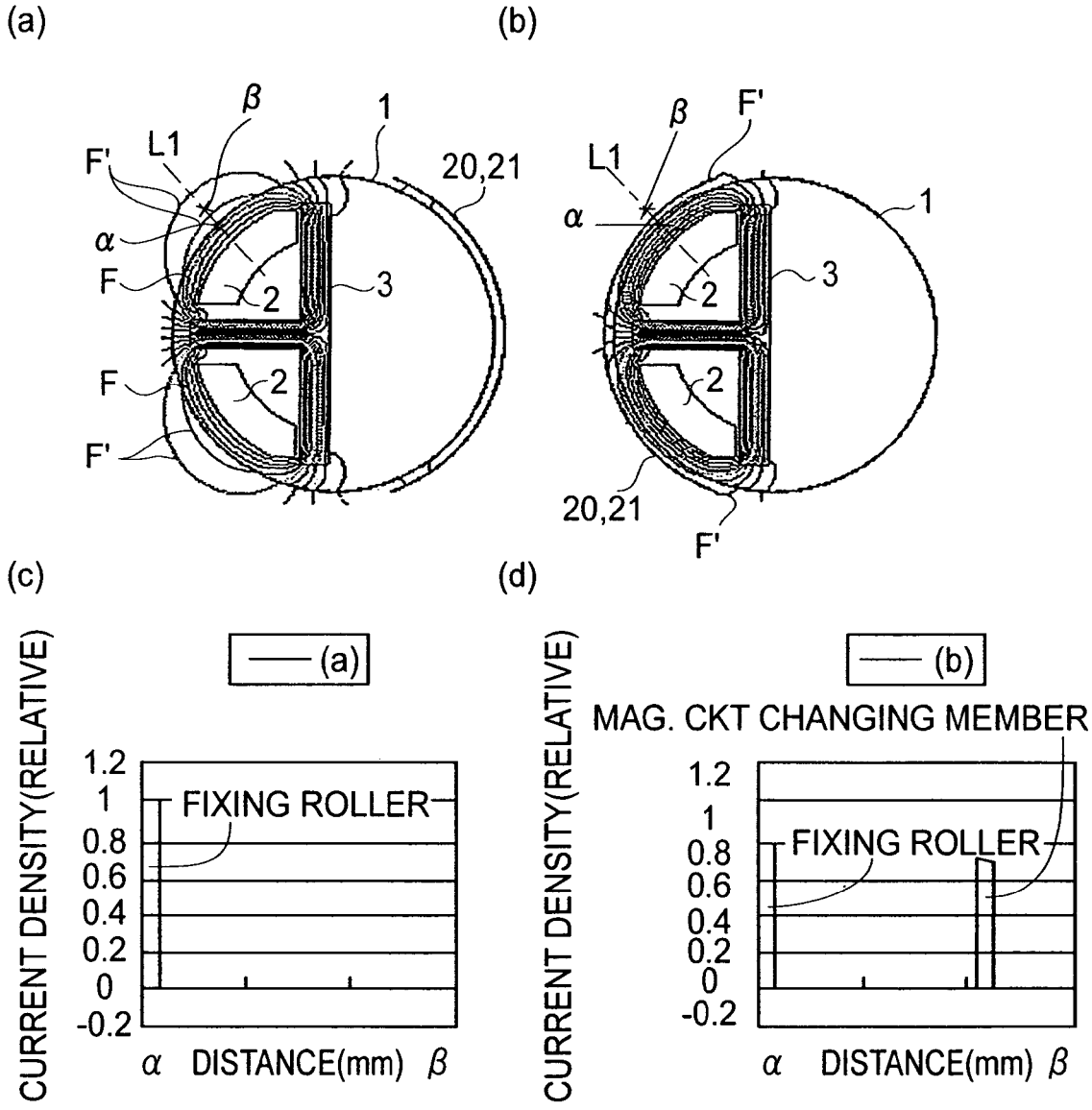
FIG. 4 is a graph showing the positional relationship among the exciting coil, fixation roller, and magnetic circuit altering member, in the fixing apparatus in the first embodiment.

FIG. 4(*a*) is a schematic drawing roughly showing the positions of the magnetic circuit altering members, and the state of the magnetic flux, while recording mediums of a large size are conveyed through the fixation nip. FIG. 4(*c*) is a graph of the electric current density between a point a and a point β in FIG. 4(*a*).

FIG. 4(*b*) is a schematic drawing roughly showing the position of the magnetic circuit altering members, and the state of the magnetic flux, while recording mediums of a small size are conveyed through the fixation nip. FIG. 4(*d*) is a graph of the electric current density between the point a and point β in FIG. 4(*b*).

The point a is the approximate center of the internal surface of the portion of the fixation roller 1 facing the top half of the exciting roller 2, in terms of the circumferential direction of the fixation roller 1. In this embodiment, the point a is referred to as point 0 mm. The point β is a point on the line L1, and is roughly 1.5 mm outward of the point a in terms of the radial direction of the fixation roller 1. The line L1 is a hypothetical line which coincides with the point a and the axial line of the fixation roller 1, in FIG. 4. In terms of the lengthwise direction of the fixation roller 1, the points a and β both are within the areas PW3, that is, the areas outside the path of a recording medium of a small size. The magnetic circuit altering member 20 (21) is rotated so that the distance between the magnetic circuit altering member 20 (21) and point a remains roughly 1.05 mm. In other words, the wall of the fixation roller 1, and the magnetic circuit altering member 20 (21), are between the points a and β.

The distance between the magnetic circuit altering member as a magnetic flux adjusting means, and the fixation roller 1, is desired to be no less than zero and no more than the coil width. Referring to FIG. 1, which is a cross-sectional view of the heating apparatus, at a plane parallel to the rotational axis of the fixation roller 1, the coil width, here, equals the length of an arc Lc of the external contour of the exciting coil, the curvature of which matches the that of the internal surface of the fixation roller 1. If the distance between the magnetic flux adjusting means and the fixation roller 1 is no less than this coil width Lc, the amount by which the magnetic flux generated by the coil reaches the magnetic flux adjusting means is rather small, and therefore, the amount by which the magnetic flux is adjusted by the magnetic flux adjusting means is rather small.

Thus, it is preferable that the distance between the magnetic flux adjusting means and fixation roller 1 is no less than 0.3 mm, and no more than the coil width. If it is no more than 0.3 mm, the magnetic flux adjusting means and fixation roller 1 come into contact with each other, causing problems related to durability, noise, etc., because of mechanical tolerance.

When the recording mediums of the large size Plare conveyed through the fixation nip N, the magnetic circuit altering member 20 (21) is rotated from the predetermined standby position into the position, which is on the opposite side of the fixation roller 1 from the exciting coil 2, as shown in FIG. 4(*a*). When the magnetic circuit altering member 20 (21) is in this position, the fixation roller 1 and the magnetic flux from the exciting coil 2 form a magnetic circuit. Therefore, electric current flows between the point a (point 0 mm) and point β (point 0.05 mm); in other words, electric current flows in the fixation roller 1, as shown in FIG. 4(*c*). Incidentally, in this embodiment, the density of the electric current which flows when the magnetic circuit altering member 20 (21) is in this position is defined as roughly 1 in terms of index. When the magnetic circuit altering member 20 (21) is in the abovementioned position, it is not involved with the magnetic flux F from the exciting coil 2. Therefore, the fixation roller 1 can be heated across the portion corresponding to the area PW1, which corresponds in size and position to the path of a recording medium of the large size P1; the efficiency with which heat is generated in the fixation roller 1 is not reduced by the magnetic circuit altering members 20 and 21. After the conveyance of the recording mediums of the large size, the magnetic circuit altering members 20 and 21 are returned to their standby positions.

On the other hand, when the recording mediums of the small size P2 are conveyed through the fixation nip N, the magnetic circuit altering member 20 (21) is rotated from the predetermined standby position into the position, which is on the exciting coil side of the fixation roller 1, as shown in FIG. 4(*b*). When the magnetic circuit altering member 20 (21) is in this position, the fixation roller 1 and the parts F' of the magnetic flux F, that is, the portion of the magnetic flux F, which have reached beyond the peripheral surface of the fixation roller 1, form a magnetic circuit, altering the magnetic flux F which is generated from the exciting coil 2 and working on the fixation roller 1, and therefore, electric current flows through the portion of the fixation roller 1 between the point a (point 0 mm) and a point 0.05 mm, that is, the point which is 0.05 mm away from the point a toward the point β, and also, the portion of the magnetic circuit altering member 20 (21) between a point 1.05 mm and a point 1.1 mm, by roughly 0.8 times that which flows when the magnetic circuit altering members 20 and 21 are in the positions shown in FIG. 4(*a*), as shown in FIG. 4(*d*).

The metallic layer 1*a* of the fixation roller 1, and the magnetic circuit altering members 20 and 21, are the same in conductivity and thickness. Therefore, the amount by which heat is generated in the fixation roller 1 by the electromagnetic induction can be reduced to roughly 0.64 (=0.8×0.8) times in index, although electrical power is generated by roughly 0.64 (=0.8×0.8) times in index, in the portions of the magnetic circuit altering members 20 and 21, which correspond to the areas PW3, that is, the areas outside the path of a recording medium of the small size.

Unlike any of the fixing apparatuses in accordance with the prior art, not only does this embodiment of a fixing apparatus in accordance with the present invention require no space for accommodating a magnetism blocking means, to be created within the magnetic flux path (magnetic circuit) formed between the fixation roller 1 and heating assembly 5, but also, it is capable of supplying the exciting coil with electric power by an optimum amount for the efficiency with which heat is generated in the fixation roller, and also, preventing the fixation roller from unwantedly increasing in temperature across the portions corresponding to the areas outside the recording medium path, regardless of the recording medium size and the operational mode of the image forming apparatus.

In this embodiment, when recording mediums of the small size are consecutively conveyed through the fixation nip N, the fixation roller 1 is prevented from increasing in temperature across the end portions thereof, by moving the conductive members as the magnetic flux adjusting members into the positions in which they oppose the portions of the fixation roller 1, which correspond in size and position to the areas outside the recording medium path. Instead, however, the portion of the fixation roller, which corresponds to the recording medium path, and the portions of the fixation rollers, which correspond to the areas outside the recording medium path, may be changed in heat distribution by changing the amount by which the magnetic flux is blocked in the area corresponding to the recording medium path, by moving the conductive members as the magnetic flux adjusting members into, or retracting from, the positions in which they oppose the portions of the fixation roller, which correspond to the recording medium path.

Embodiment 2

In this embodiment, the magnetic circuit altering members 20 and 21 are different in thickness or conductivity from the metallic layer 1*a* of the fixation roller 1. The structural components of the fixating apparatus in this embodiment, which are identical to those of the fixing apparatus in the first embodiment are given the same referential symbols as those given in the first embodiment, in order to avoid repeating the same descriptions.

Figure 5:
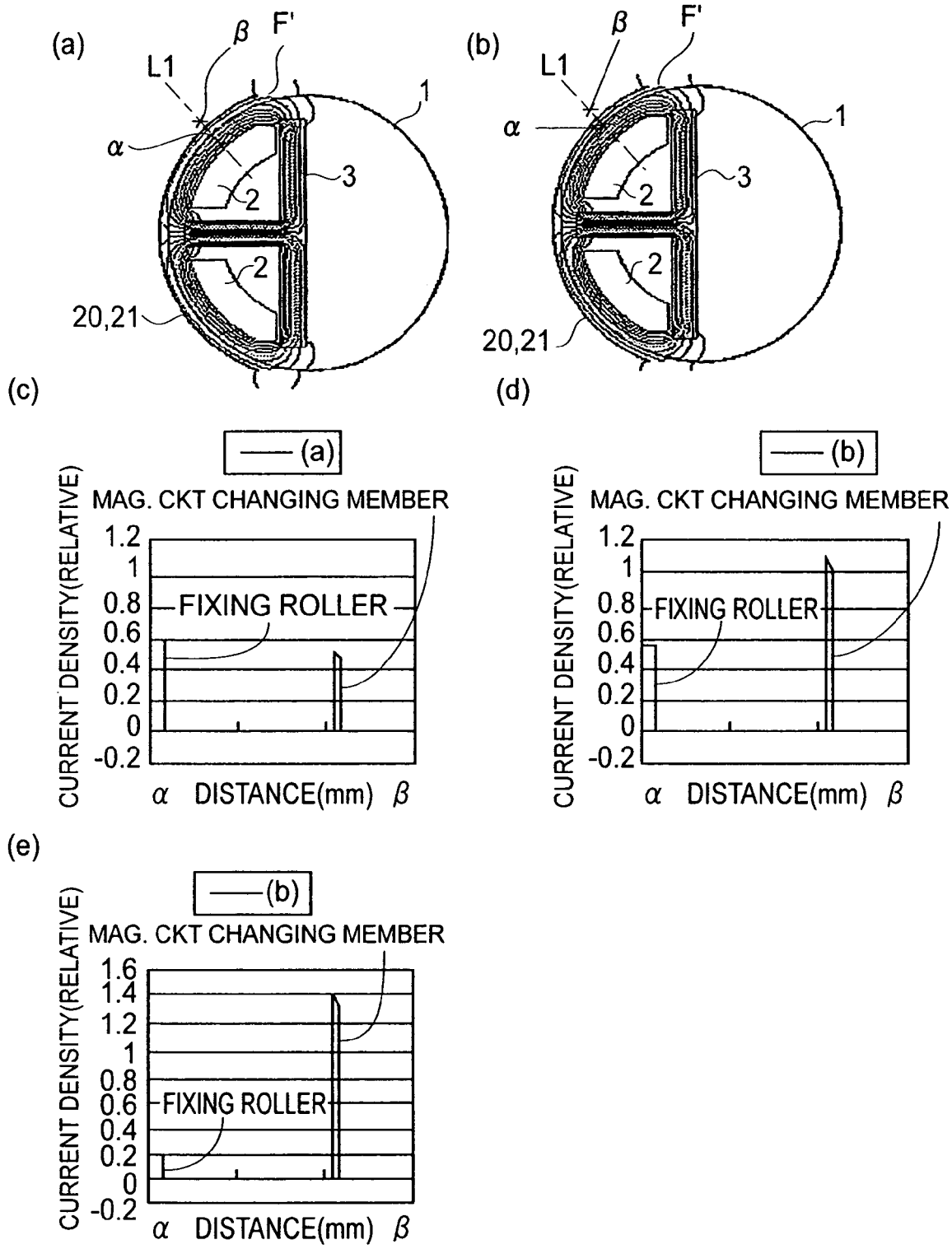
FIG. 5 is a graph showing the positional relationship among the exciting coil, fixation roller, and magnetic flux altering member, in the fixing apparatus in the second embodiment.

FIG. 5(*a*) is a schematic drawing roughly showing the positions of the magnetic circuit altering members, and the state of the magnetic flux, while recording mediums of the small size are conveyed through the fixation nip. FIG. 5(*c*) is a graph of the electric current density between a point a and a point β in FIG. 5(*a*). The magnetic circuit altering members 20 and 21 are twice in thickness as that of the metallic layer 1*a* of the fixation roller 1, but, are the same in conductivity as that of the metallic layer 1.

FIG. 5(*b*) is a schematic drawing roughly showing the position of the magnetic circuit altering members, and the state of the magnetic flux, while recording mediums of the small size are conveyed through the fixation nip. FIG. 5(*d*) is a graph of the electric current density between the point a and point β in FIG. 5(*b*). The magnetic circuit altering members 20 and 21 shown in FIG. 15(*b*) are the same in thickness as the metallic layer 1*a* of the fixation roller 1, but, are twice in conductivity as the metallic layer 1*a*.

FIG. 5(*e*) is a graph of the electric current density between a point a and a point β of a fixing apparatus, the magnetic circuit altering members 20 and 21 of which are the same in thickness as the metallic layer 1*a* of the fixation roller 1, but, are 10 times in conductivity as the metallic layer 1*a*.

When recording mediums of the large size are conveyed through the fixation nip, the operation of this fixating apparatus is the same as that of the fixing apparatus in the first embodiment of the present invention. Therefore, it will not be described.

In the case of the fixing apparatus, the magnetic circuit altering members 20 and 21 of which have twice the thickness of the metallic layer 1*a* of the fixation roller 1, while recording mediums of the small size are conveyed through the fixation nip N, electric current flows by roughly 0.6 times in terms of index, between the points a (0 mm point) and point 0.05 mm, that is, the 0.05 mm away from the point a in the direction of the point β, of the fixation roller 1, and also, between the point 1.05 mm and point 1.15 mm of the magnetic circuit altering members 20 and 21, as shown in FIG. 5(*c*).

In other words, since the magnetic circuit altering members 20 and 21 are the same in conductivity as the metallic layer 1*a* of the fixation roller 1, and their thickness is twice that of the metallic layer 1*a*, it is possible to keep the amount of the heat generated in the fixation roller 1 by electromagnetic induction, to roughly 0.36 (=0.6×0.6) times in terms of index, although the amount by which electric power is generated in the magnetic circuit altering members 20 and 21, in the areas outside the path of a recording medium of the small size is 0.72 (0.6×0.6×2) times in terms of index.

In the case of the fixing apparatus, the magnetic circuit altering members 20 and 21 of which have twice the conductivity of the metallic layer 1*a* of the fixation roller 1, while recording mediums of the small size are conveyed through the fixation nip N, the amount of the electric current which flows between the points a (point 0 mm) and point 0.05 mm, that is, a point which is 0.05 mm away from the point a toward the point β, in the fixation roller 1 is roughly 0.6 times in terms of index, and the amount the electric current which flows through the magnetic circuit altering members 20 and 21, between the 1.05 mm point and 1.1 mm point, is roughly 1.0 time in terms of index, as shown in FIG. 5(*d*).

In other words, since the magnetic circuit altering members 20 and 21 are twice in conductivity as the metallic layer 1*a* of the fixation roller 1, and the same in thickness as the metallic layer 1*a*, it is possible to keep the amount of the heat generated by electromagnetic induction in the portions of the fixation roller 1, which correspond to the areas outside the path of a recording medium of the small size, to roughly 0.36 (=0.6×0.6) times in terms of index, although the amount by which electric power is generated in the magnetic circuit altering members 20 and 21, in the areas outside the path of a recording medium of the small size, is roughly 0.5 (1.0×1.0/2) times in terms of index.

Further, in the case of the fixing apparatus, the magnetic circuit altering members 20 and 21 of which have 10 times the conductivity of the metallic layer 1*a* of the fixation roller 1, while recording mediums of the small size are conveyed through the fixation nip N, the amount by which electric current flows between the points a (point 0 mm) and the point 0.05 mm, that is, the point which is 0.05 mm away from the point a toward the point β (point 0.05 mm), of the fixation roller 1 is roughly 0.2 times in terms of index, and the amount by which electric current flows through the fixation roller 1, between the point 1.05 mm and point 1.1 mm is roughly 1.4 times in terms of index, as shown in FIG. 5(*e*).

In other words, since the magnetic circuit altering members 20 and 21 is 10 times in conductivity as the metallic layer 1*a* of the fixation roller 1, and the same in thickness as the metallic layer 1*a*, it is possible to keep the amount of the heat generated by electromagnetic induction in the fixation roller 1 to roughly 0.04 (=0.2×0.2) times in terms of index, although the amount by which electric power is generated in the magnetic circuit altering members 20 and 21, across the portions outside the path of a recording medium of the small size, is roughly 0.2 (1.4×1.4/10) times in terms of index.

In the case of the fixing apparatus in this embodiment, the need for creating in the magnetic flux path (magnetic circuit) formed between the fixation roller 1 and heating assembly 5, a space in which a magnetism blocking means such as that in accordance with any of the prior arts is to be placed, can be eliminated by rendering the product of the conductivity and thickness of the magnetic circuit altering member 20 (21) greater than the product of the conductivity and thickness of the metallic layer 1*a* of the fixation roller 1. Therefore, not only is it possible to keep the fixation roller 1 lower in temperature, across the portions, which correspond in size and position to the areas outside the recording medium path, than those in the first embodiment, but also, it is possible to optimize the temperature of the fixation roller, across the portions, which correspond to the areas outside the recording medium path. Therefore, it is possible, regardless of the operational mode regarding the recording medium size (whether recording mediums to be used for image formation are large or small), to supply the exciting coil with the optimal amount of electric power for the efficiency with which heat is generated in the fixation roller. Therefore, it is possible to prevent the fixation roller from increasing in temperature, across the portions which correspond to the areas outside the recording medium path.

Embodiment 3

Figure 6:
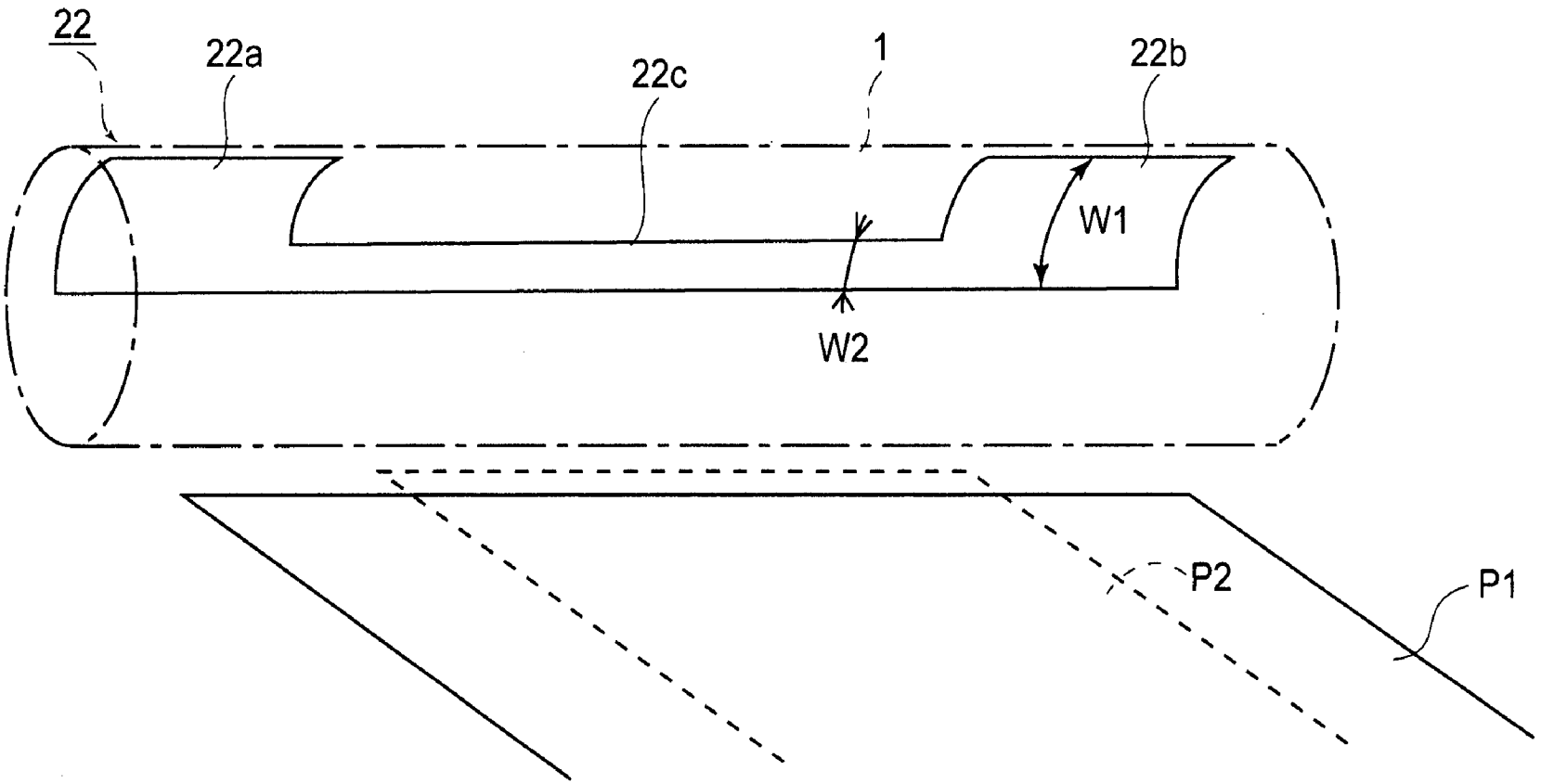
FIG. 6 is a perspective view of the magnetic circuit altering member employed by the fixing apparatus in the third embodiment.

The fixing apparatus in this embodiment is provided with the magnetic circuit altering member 22 shown in FIG. 6. The structural components of this fixing apparatus, which are the same as those of the fixing apparatus in the first embodiment are given the same referential symbols as those given to the structural components the fixing apparatus in the first embodiment, and they will not be described.

Figure 7:
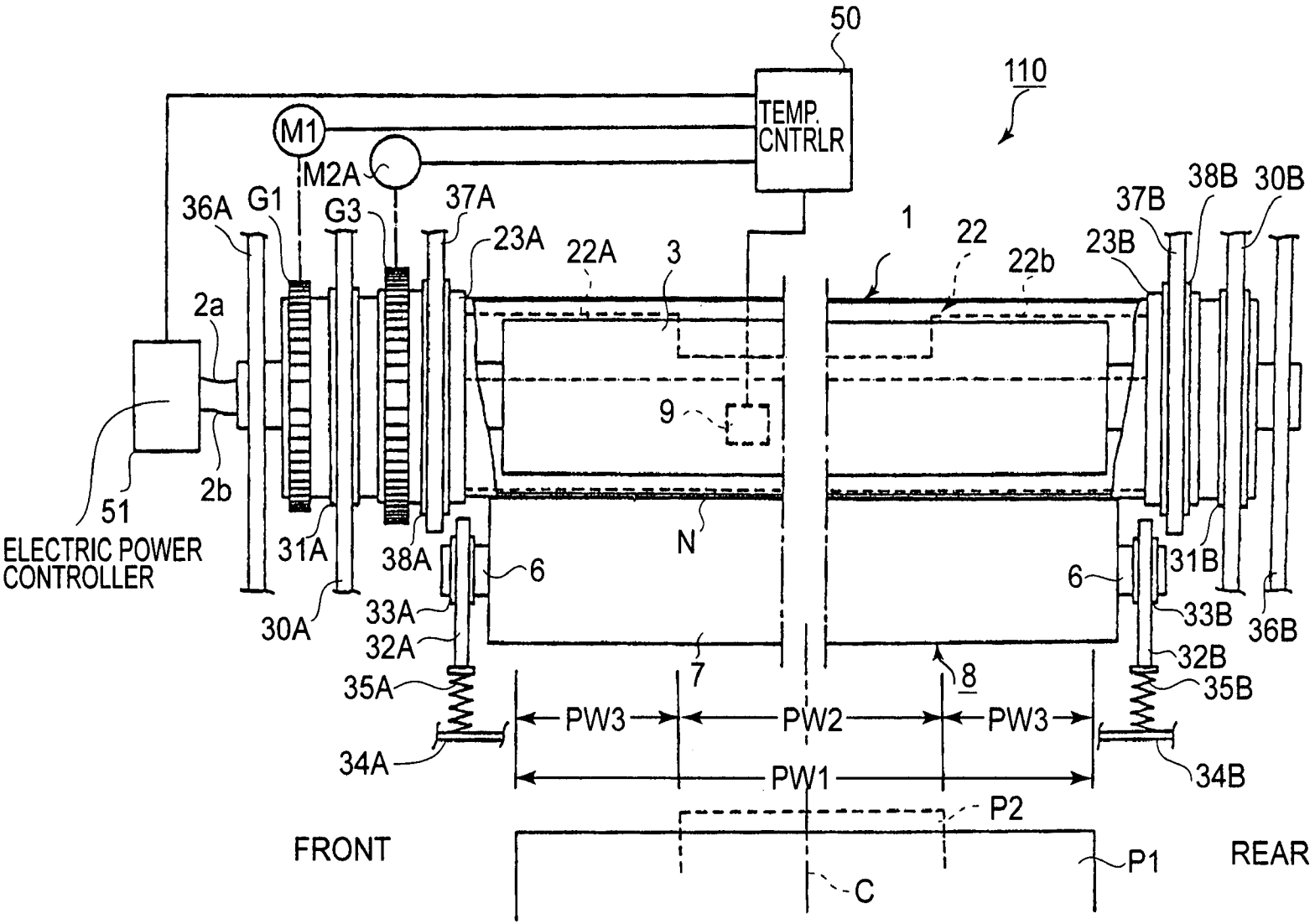
FIG. 7 is a schematic drawing (partially cut-away) of the fixing apparatus in the third embodiment, as seen from the direction perpendicular to the lengthwise direction of the apparatus.

FIG. 6 is an external perspective view of the magnetic circuit altering member 22, and FIG. 7 is a front view (partially cut-away) of the fixing apparatus 110 in this embodiment (as seen from direction perpendicular to lengthwise direction apparatus).

The magnetic circuit altering member 22 has a pair of first portions 22*a* and 22*b*, which correspond one for one to the areas PW3, that is, the areas outside the path of a recording medium of the small size, and a second portion 22*c* which is the portion between the pair of first portions 22*a* and 22*b*. The first portions 22*a* and 22*b*, and second portion 22*c*, are arcuate, and their curvature matches that of the peripheral surface of the fixation roller 1. The first portion 22*a*, or one of the pair of first portions of the magnetic circuit altering member 22, is provided with a cylindrical holding portion 23A, which is attached to the outward lengthwise end of the first portion 22*a*. In the hollow of this holding member 23A, the corresponding end portion of the fixation roller 1 is disposed, with no contact between the holding member and fixation roller 1, and is rotatably held by the lateral plate 37A of the chassis of the fixing apparatus, with the interposition of a bearing 38A. As for the first portion 22*b*, or the other of the pair of first portions, it is provided with a cylindrical supporting member 23B, which is attached to the outward lengthwise end of the first portion 22*b*. In the hollow of the this holding member 23B, the corresponding end portion of the fixation roller 1 is disposed, with no contact between the holding member 23B and fixation roller 1, and is rotatably held by the lateral plate 37B of the chassis of the fixing apparatus, with the interposition of a bearing 38B.

The holding member 23A is provided with a magnetic circuit altering member driving gear G3, which is rigidly attached to the holding member 23A. This gear G3 can be rotationally driven by the driving force transmission system M2A, which is controlled by the control circuit 50, to rotate the holding member 23A from the predetermined standby position to one of the two predetermined positions, that is, the top and bottom positions, on the exciting coil side of the fixation roller 1, where the abovementioned magnetic flux is higher in density, or the predetermined position on the opposite side of the fixation roller 1 from the exciting coil, where the magnetic flux is lower in density. More specifically, when recording mediums of the small size are conveyed through the fixation nip, the holding member 23A is rotated into the top or bottom position on the exciting coil side, whereas when recording mediums of the large size are conveyed through the fixation nip, the holding member 23A is rotated into the position on the opposite side of the fixation roller 1 from the exciting coil (where it does not shield fixation roller from heating assembly).

In terms of the direction parallel to the rotational direction of the magnetic circuit altering member 22, the width W1 of the first portions 22*a* and 22*b* of the magnetic circuit altering member 22 is greater than the width W2 of the second portion 22*c* of the magnetic circuit altering member 22. As described above, when recording mediums of the small size are conveyed through the fixation nip, the first and second portions 22*a* and 22*b* of the magnetic circuit altering member 22 are positioned on the exciting coil side of the fixation roller 1. As for the material for the magnetic circuit altering member 22, the same metallic substance as that for the metallic layer 1*a* of the fixation roller 1 is used. The conductivity and thickness of the magnetic circuit altering member 22 are the same as those of the metallic layer 1*a*.

Figure 8:
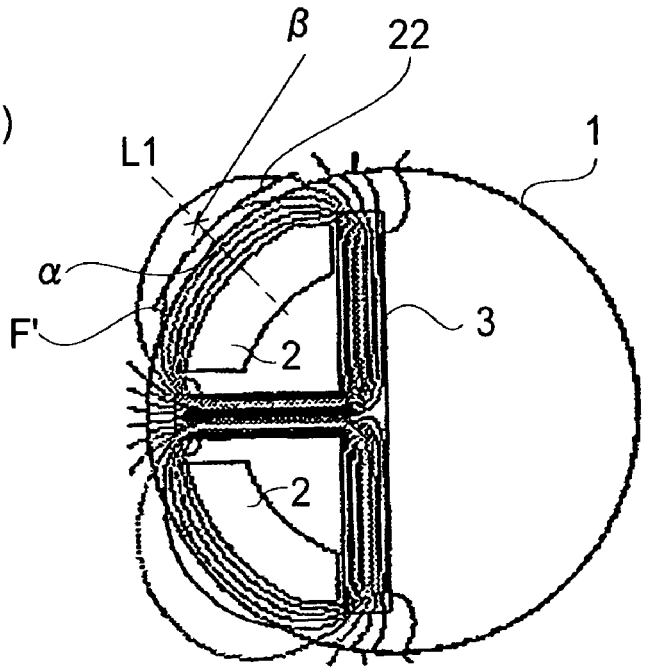
FIG. 8 is a graph showing the positional relationship among the exciting coil, fixation roller, and magnetic circuit altering member, in the fixing apparatus in the third embodiment.
Figure 8:
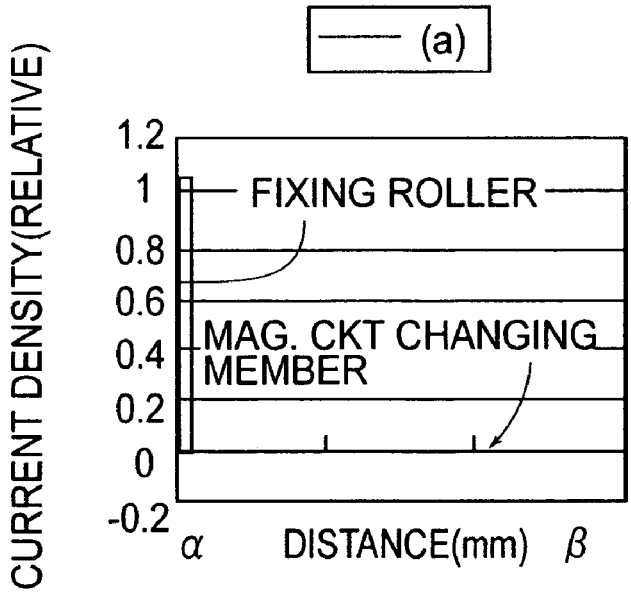

FIG. 8(*a*) is a schematic drawing roughly showing the position of the magnetic circuit altering member and the state of the generated magnetic flux while the recording mediums of the small size are conveyed through the fixation nip. FIG. 8(*b*) is a graph of the electric current density between the points a and β in FIG. 8(*a*).

Referring to FIG. 8(*a*), the amount by which electric current flows between the points a (point 0 mm) and point 0.05 mm, that is, the point which is 0.05 mm away from the point a toward the point β, in the fixation roller 1, is roughly 1.0 time in index, and the amount by which electric current flows between the point 1.05 mm and point 1.10 mm of the magnetic circuit altering member 22 is roughly 0.05 times in index.

In other words, the magnetic circuit altering member 22 is the same in conductivity and thickness as the metallic layer 1*a* of the fixation roller 1.

Therefore, the amount by which electric power is generated in the magnetic circuit altering member 22 while the magnetic circuit altering member 22 is in the position on the exciting coil side of the fixation roller 1, that is, when recording mediums of the small size are conveyed through the fixation nip, can be kept below roughly 0.025 (0.05×0.05) times in index, and the fixation roller 1 can be supplied with electric power by the amount sufficient for maintaining the amount of heat generated by electromagnetic induction at a level roughly 1.0 time in index.

In the case of the fixing apparatus in this embodiment, when recording mediums of the small size are conveyed through the fixation nip, the magnetic circuit altering member 22 is rotated into the position in which the first and second portions 22*a* and 22*b* and second portion 22*c* of the magnetic circuit altering member 22 are all on one side of the exciting coil 2. Therefore, the magnetic circuit altering member 22 does not need to be rotated as much as the corresponding member in the preceding embodiments, making it possible to provide the fixing apparatus with a magnetic circuit altering mechanism for supporting the magnetic circuit altering member by the lengthwise ends, which is more stable in structure. Further, it is possible, regardless of the operational mode regarding the recording medium size (whether recording mediums to be used for image formation are large or small), to supply the exciting coil with the optimal amount of electric power for the efficiency with which heat is generated in the fixation roller. Therefore, it is possible to prevent the fixation roller from increasing in temperature, across the portions which correspond to the areas outside the recording medium path.

Embodiment 4

Figure 9:
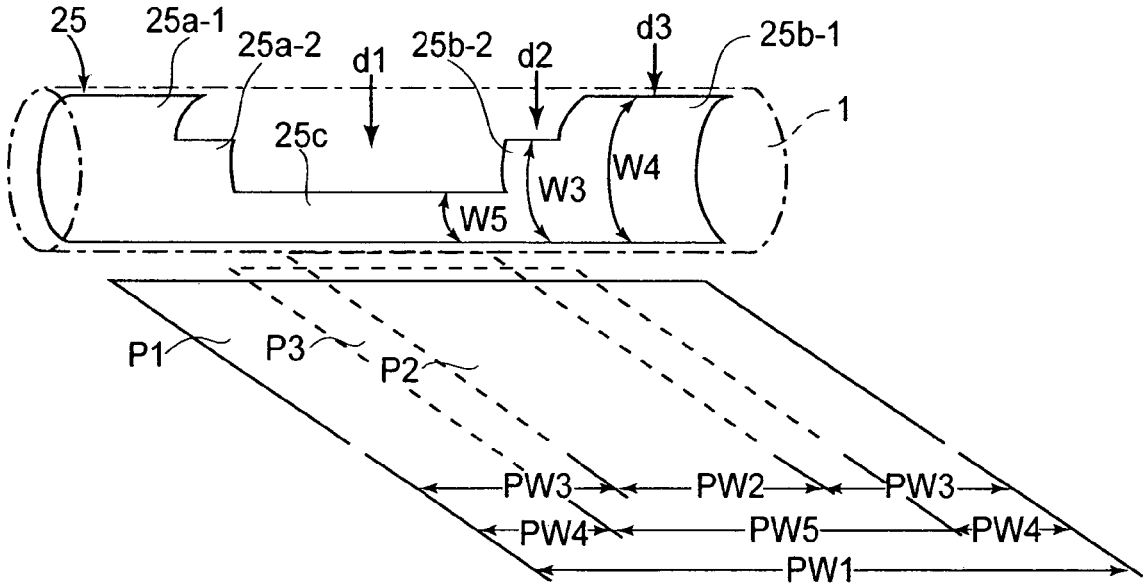
FIG. 9 is a perspective view of the magnetic circuit altering member employed by the fixing apparatus in the fourth embodiment.

In this embodiment, the fixing apparatus is provided with a magnetic circuit altering member 25, shown in FIG. 9, instead of the magnetic circuit altering member with which the fixing apparatus in the third embodiment was provided. The structural components of this fixing apparatus, which are identical to those of the fixing apparatus in the first embodiment are given the same referential symbols as those given to the corresponding structure components in the first embodiment, and will not be described to avoid the repetition of the same descriptions.

FIG. 9 is an external perspective view of the magnetic circuit altering member 25.

Designated by a referential symbol PW4 are the areas outside the path of a recording medium of a medium size (P2), that is, a size between the large size (P1) and small size (P2), that is, the areas in which a recording medium of the medium size does not come into contact with the fixation roller 1 while the recording medium of the medium size (P2) is conveyed through the fixation nip. Designated by a referential symbol PW5 is the area which corresponds in position and width to the path of a recording medium of the medium size while a recording medium of the medium size is conveyed through the fixation nip.

The magnetic circuit altering member 25 is provided with a pair of first portions 25*a*-1 and 25*b*-1, a pair of portions 25*a*-2 and 25*b*-2, and a second portion 25*c*. The first portions 25*a*-1 and 25*b*-1 are the outermost portions in terms of the lengthwise direction of the fixation roller 1, and correspond, one for one, to the areas PW4, that is, the areas outside the path of a recording medium of the medium size, and the portions 25*a*-2 and 25*b*-2 are the portions on the immediately inward side of the first portions 25*a*-1 and 25*b*-1, respectively, and correspond to the areas PW3, that is, the areas outside the path of a recording medium of the medium size. The second portion 25*c* is the portion between the pair of inward portions 25*a*-2 and 25*b*-2. In terms of the moving direction of the magnetic circuit altering member 25, the width W4 of the outermost portions 25*a*-1 and 25*b*-1 is greater than the width W3 of the inward portions 25*a*-2 and 25*b*-2, which is greater than the than the width W5 of the second portion 25*c*.

When a recording medium of the small size, a recording medium of the medium size, or a recording medium of the large size, is conveyed through the fixation nip, this magnetic circuit altering member 25 is rotationally moved from the predetermined standby position to the corresponding position among the predetermined positions, on the exciting coil side of the fixation roller 1 where the generated magnetic flux F is higher in density as described above.

Figure 10:
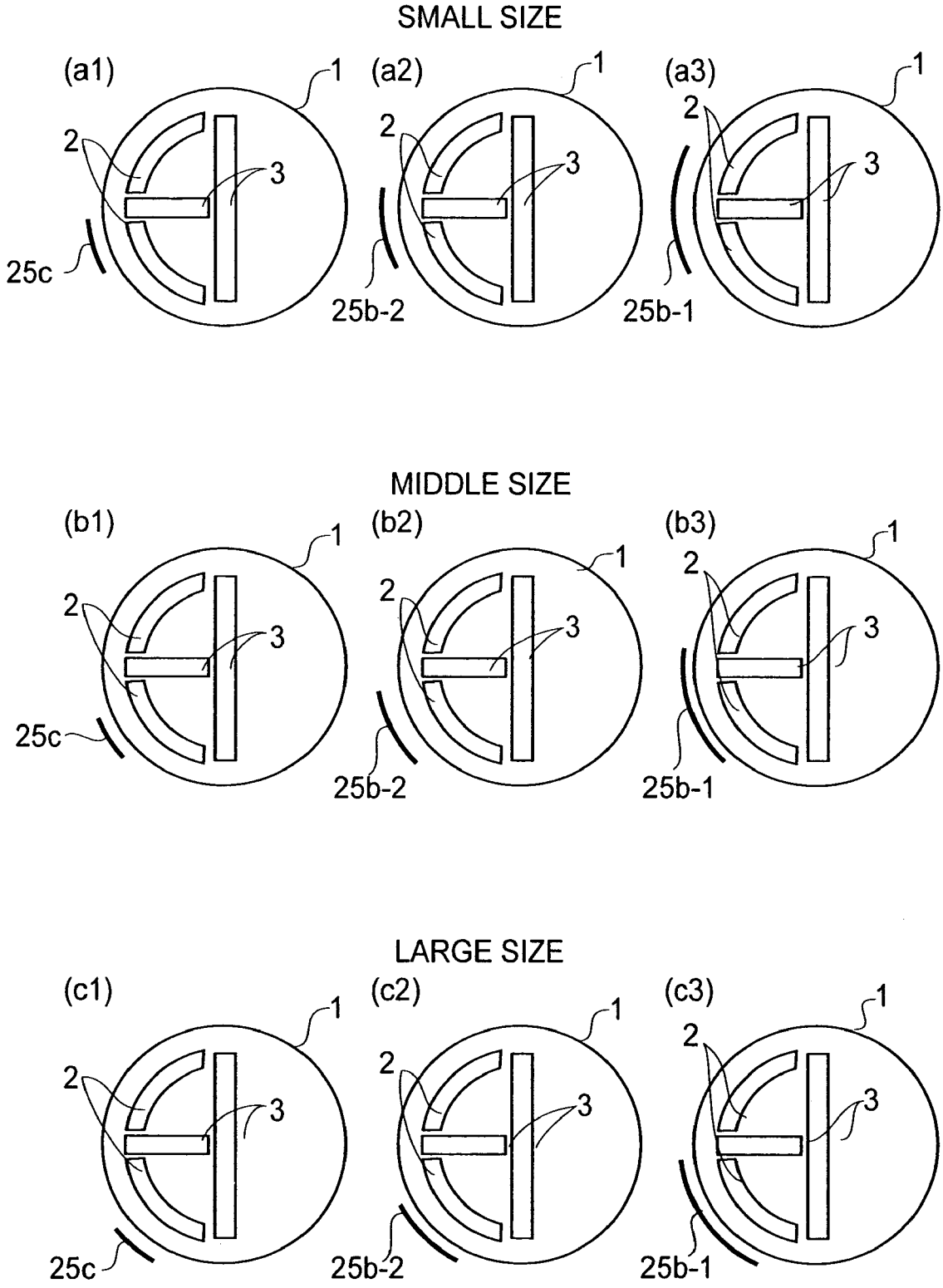
FIG. 10 is a graph showing the positional relationship among the exciting coil, fixation roller, and magnetic flux altering member, in the fixing apparatus in the fourth embodiment.

FIG. 10 is a schematic sectional view of the fixing apparatus in this embodiment. FIGS. 10(*a*1), 10(*a*2), and 10(*a*3), FIGS. 10(*b*1), 10(*b*2), and 10(*b*3), and FIGS. 10(*c*1), 10(*c*2), and 10(*c*3), correspond, respectively, to when a recording medium of the small size, a recording medium of the medium size, and a recording medium of the large size, are conveyed through the fixation nip. Further, FIGS. 10(*a*1), 10(*b*1), and 10(*c*1), FIGS. 10(*a*2), 10(*b*2), and 10(*b*3), and FIGS. 10(*c*1), 10(*c*2), and 10(*c*3) correspond to the positions d1 (of second portion 25*c*), d2 (of inward portion 25*b*-2), and d3 (of outward portion 25*b*-1).

When a recording medium of the small size is conveyed through the fixation nip, the magnetic circuit altering member 25 is rotated into the position in which its second portion 25*c* opposes the half (bottom) of the exciting coil 2 (FIG. 10(*a*1). In this case, the outermost portions 25*a*-1 and 25*b*-1, and the inward portions 25*a*-2 and 25*b*-2, oppose both the top and bottom portions of the exciting coil 2 in a manner of straddling the magnetic core (FIGS. 10(*a*2) and 10(*a*3), respectively).

When the magnetic circuit altering member 25 opposes only one half of the exciting coil 2, in terms of the vertical direction, as in the first embodiment, heat can be generated in the fixation roller 1 by electromagnetic induction. However, when the magnetic circuit altering member 25 opposes both the top and bottom halves of the exciting coil 2, heat cannot be generated in the fixation roller 1 by electromagnetic induction.

In other words, heat can be generated in the portion of the fixation roller 1, which corresponds to the path of a recording medium of the small size P2 (area PW2), but, heat is prevented by the outermost and inward portions of the magnetic circuit altering member 25, from being generated in the portions of the fixation roller 1 which correspond to the areas PW3, that is, the areas outside the path of a recording medium of the small size. Therefore, these portions of the fixation roller 1 are prevented from increasing in temperature.

When a recording medium of the medium size is conveyed through the fixation nip, the magnetic circuit altering member 22 is rotated into the position in which its second portion 25*c* and inward portions 25*a*-2 and 25*b*-2 oppose the center portion of one half (bottom) of the exciting coil 2 (FIGS. 10(*b*1) and 10(*b*2). In this case, the outermost portions 25*a*-1 and 25*b*-1 of the magnetic circuit altering member 25 oppose both the top and bottom portions of the exciting coil 2 in a manner to straddle the magnetic core 3 (FIG. 10(*b*3)).

Also in this case, the portion of the fixation roller 1, which corresponds in size and position to the path of a recording medium of the medium size P2 (area PW5), can be heated for the same reason as the reason why they can be heated in the third embodiment. However, heat is prevented by the outermost portions of the magnetic circuit altering member, from being generated by electromagnetic induction, in the portions of the fixation roller 1, which correspond in size and position to the areas PW4, that is, the areas outside the path of a recording medium of the medium size. Therefore, these portions of the fixation roller 1 are prevented from increasing in temperature.

When a recording medium of the large size is conveyed through the fixation nip, the magnetic circuit altering member 25 is rotated into the position in which its second portion 25*c*, inward portions 25*a*-2 and 25*b*-2, and outermost portions 25*a*-1 and 25*b*-1 oppose the half (bottom) of the exciting coil 2 (FIGS. 10(*c*1), 10(*c*2), and 10(*c*3)).

Also in this case, the portion of the fixation roller 1, which corresponds in size and position to the path of a recording medium of the large size P1 (area PW1), can be heated for the same reason as the reason why they can be heated in the third embodiment.

As described above, the magnetic circuit altering member of the fixing apparatus in this embodiment has the outermost portions 25*a*-1 and 25*b*-1 as the first portions, inward portions 25*a*-2 and 25*b*-2, and center portion 25*c*, and the widths W4 and W3 of the outermost portions and inward portions, respectively, are rendered greater than the width W5 of the center portion. Further, they are rendered different in dimension also in terms of the lengthwise direction of the fixation roller 1. Therefore, not only is it possible to supply the fixing apparatus (exciting coil) with an optimum amount of electric power for the efficiency with which heat is generated in the fixation roller, but also, to prevent the fixation roller from increasing in temperature across the portions outside the recording medium path.

[Miscellanies]

1) The shape of the heating means in which heat is generated by electromagnetic induction does not need to be limited to a cylindrical one. That is, the heating means may be in the form of a circularly movable member such as a piece of film, an endless belt, or the like. Further, the heating means does not need to be laminar, that is, it may be formed of a single piece of metallic substance in which heat can be generated by electromagnetic induction, or may be formed as a compound member (laminar member) having two or more layers, that is, a metallic layer in which heat can be generated by electromagnetic induction, and one or more layers formed of heat resistant resin, ceramic, etc.

Figure 11:
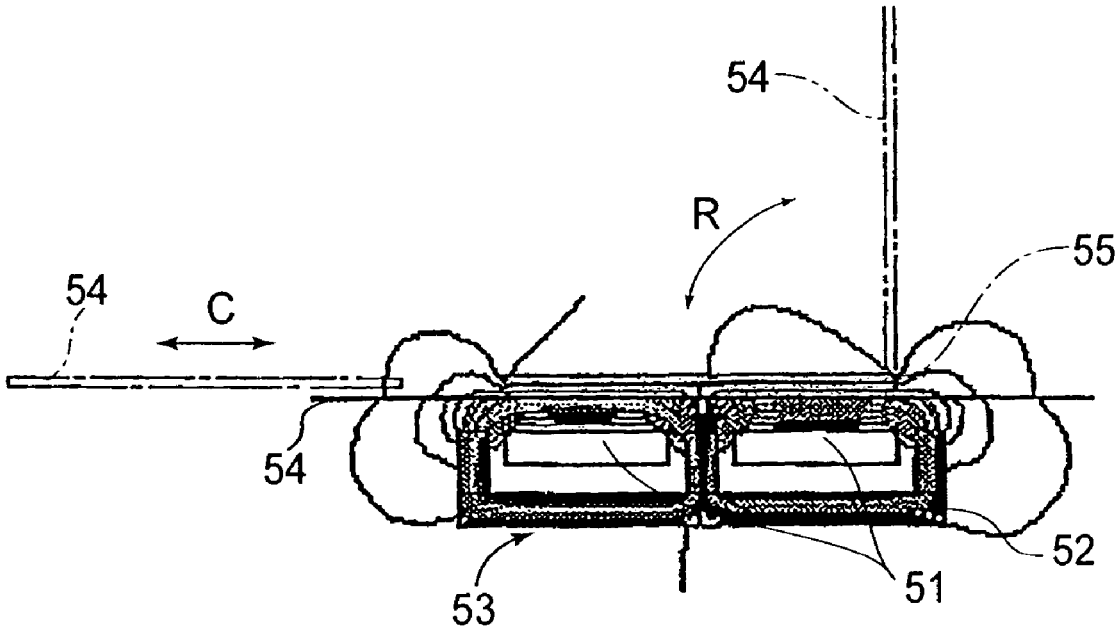
FIG. 11 is a schematic sectional view of an example of a fixing apparatus to which the present invention is applicable, and which employs a fixation belt.

FIG. 11 is an enlarged schematic drawing of the essential portions of an image heating apparatus employing an endless belt 50 as a heating means in which heat can be generated by electromagnetic induction. The endless belt 50 is disposed between the heating assembly 50 comprising the exciting coil 51, magnetic core 52, etc., and magnetic circuit altering member 54, which can be moved by an optional selection of driving means 54 such as a reversible motor, to the position in which it allows the endless belt to be exposed to a large amount of magnetic flux generated by the heating assembly 53, or the position in which it allows the endless belt to be exposed only a very small amount of magnetic flux generated by the heating assembly 53. The position of the magnetic circuit altering member 54 outlined by a solid line is where the magnetic flux is high in density. As for the position into which the magnetic circuit altering member 54 is to be moved, and where the magnetic flux is low in density, the magnetic circuit altering member 54 may be moved in the direction (indicated by arrow mark C) parallel to the circumferential direction of the endless belt 50 into the position outlined by a single-dot chain line, or in the width direction (direction perpendicular to surface of paper bearing FIG. 11). In such a case, it is desired that the magnetic circuit altering member 54 and driving means 55 are connected to each other, with a driving force transmission mechanism such as a rack-and-pinion mechanism. Further, the magnetic circuit altering member 54 may be rotated in the direction indicated by an arrow mark R into the position which is outlined by a double-dot chain line, and in which the magnetic circuit altering member 54 is perpendicular to the endless belt 50. In this case, it is recommendable that the magnetic circuit altering member 54 and driving means 55 are connected to each other, with a driving force transmission mechanism such as a reduction mechanism.

2) The method for heating a heating member by generating heat in the heating member by electromagnetic induction with the use of a magnetic field generating means does not need to be limited to the method in the preceding embodiments, in which the heating member is heated from within the heating member. In other words, a heating apparatus may be structured to dispose the magnetic field generating means, outside the heating means in which heat is generated by electromagnetic induction, so that the heating means can be heated from the outward side of the heating means.

3) In each of the fixing apparatuses in the preceding embodiments, the magnetic circuit altering member was supported so that it can be rotated relative to the rigidly held exciting coil of the heating assembly. However, the heating assembly, instead of the magnetic circuit altering member, may be rotatably supported so that the heating assembly can be rotated relative to the rigidly held magnetic circuit altering member, and fixation roller. A heating apparatus with such a structural arrangement is the same in function and effect as the fixing apparatuses in the preceding embodiments.

4) The heating apparatuses in the preceding embodiments were structured so that when a recording medium is conveyed through the heating apparatuses, the centerline of the recording medium is kept aligned with the centerline of the fixation roller, in terms of the lengthwise direction of the fixation roller.

However, the present invention is also effectively applicable to a heating apparatus in which a recording medium is conveyed through the apparatus so that one of the lateral edges of the recording medium is kept aligned with the positional referential member of the apparatus.

5) The usage of the image heating apparatus, in accordance with the present invention, which employs the heating method based on electromagnetic induction, is not limited to the usage as the thermal fixing apparatus for an image forming apparatus like those in the preceding embodiments. For example, it is also effective as such an image heating apparatus as a fixing apparatus for temporarily fixing an unfixed image to a sheet of recording paper, a surface property changing apparatus for reheating a sheet of recording paper bearing a fixed image to change the sheet of recording medium in surface properties, such as glossiness.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No. 308507/2004 filed Oct. 22, 2004, which is hereby incorporated by reference.

What is claimed is:

1. An image heating apparatus comprising:

magnetic flux generating means having a coil for generating a magnetic flux;

a rotatable heat generation member having an electroconductive layer for generating heat by the magnetic flux for heating an image on a recording material by the heat, said electroconductive layer having a thickness smaller than its skin depth;

an electroconductive member which is disposed across said electroconductive layer from said magnetic flux generating means; and moving means for moving said electroconductive member to such a position that an end portion of an opposing portion of said heat generation member opposed to said coil is between said coil and said electroconductive member when a recording material having a width, measured in a direction perpendicular to a feeding direction of the recording material, is smaller than a maximum width of recording materials which can be processed by said apparatus.

2. An apparatus according to claim 1, wherein a product of an electrical conductivity of the electroconductive member and a thickness thereof is larger than a product of an electrical conductivity of said heat generation member and a thickness of said heat generation member.

3. An apparatus according to claim 1, wherein said electroconductive member has portions having different lengths measured in the rotational axis direction.

4. An apparatus according to claim 1, wherein a plurality of such electroconductive members are provided, and said electroconductive members are capable of opposing respective ends of a heat generation member with respect to the rotational axis direction.

5. An apparatus according to claim 1, wherein said electroconductive member is capable of opposing the opposite ends of said heat generation member.

6. An apparatus according to claim 1, wherein said electroconductive member has a thickness which is larger than a thickness of the electroconductive layer.

7. An apparatus according to claim 1, wherein said electroconductive member includes a plurality of portions having different lengths measured in a direction of movement of said electroconductive member.

8. An apparatus according to claim 1, further comprising changing means for changing a stop position of said electroconductive member in accordance with a length of the recording material measured in a direction perpendicular to a feeding direction of the recording material.

* * * * *

UNITED STATES PATENT AND TRADEMARK OFFICE

CERTIFICATE OF CORRECTION

PATENT NO. : 7,326,890 B2
APPLICATION NO. : 11/254810
DATED : February 5, 2008
INVENTOR(S) : Joji Nagahira It is certified that error appears in the above-identified patent and that said Letters Patent is hereby corrected as shown below:

COLUMN 1
Line 45, “above described” should read --above-described--.

COLUMN 2
Line 7, “control” should read --to control--.

COLUMN 3
Line 48, “laser based” should read --laser-based--.

COLUMN 8
Line 51, “above” should read --above- --.

COLUMN 9
Line 52, “point a” should read --point α--.
Line 59, “a” should read --α--.
Line 60, “point a” should read --point α--.
Line 64, “point a” should read --point -α-.
Line 66, “a” should read --α--.

COLUMN 10
Line 1, “a” should read --α--.
Line 3, “a” should read --α--.
Line 7, “point a” should read --point α--.
Line 9, “points a” should read --points α--.
Line 18, “the that” should read --that--.
Line 33, “Plare” should read --P1 are--.
Line 41, “point a” should read --point α--.

COLUMN 11
Line 4, “point a” should read --point α--.
Line 5, “point a” should read --point α--.

UNITED STATES PATENT AND TRADEMARK OFFICE

CERTIFICATE OF CORRECTION

PATENT NO. : 7,326,890 B2
APPLICATION NO. : 11/254810
DATED : February 5, 2008
INVENTOR(S) : Joji Nagahira It is certified that error appears in the above-identified patent and that said Letters Patent is hereby corrected as shown below:

COLUMN 12
Line 1, “point a” should read --point α--.
Line 11, “a” should read --α--.
Line 16, “point a” should read --point α--.
Line 30, “points a” should read --points α--.
Line 32, “point a” should read --point α--.
Line 51, “points a” should read --points α--.
Line 54, “amount” should read --amount of--.

COLUMN 13
Line 9, “points a” should read --points α--.
Line 11, “point a” should read --point α--.
Line 59, “components” should read --components of--.

COLUMN 14
Line 63, “points a” should read --points α--.
Line 65, “points a” should read --points α--.
Line 67, “point a” should read --point α--.

COLUMN 15
Line 1, “time” should read --times--.
Line 17, “time” should read --times--.

UNITED STATES PATENT AND TRADEMARK OFFICE

CERTIFICATE OF CORRECTION

PATENT NO. : 7,326,890 B2
APPLICATION NO. : 11/254810
DATED : February 5, 2008
INVENTOR(S) : Joji Nagahira It is certified that error appears in the above-identified patent and that said Letters Patent is hereby corrected as shown below:

COLUMN 16
Line 39, "10(a1)." should read --10(a1)).--.
Line 67, "10(b2)." should read --10(b2)).--.

Signed and Sealed this

Thirtieth Day of September, 2008

JON W. DUDAS
*Director of the United States Patent and Trademark Office*